US007572175B2

(12) United States Patent
Ido

(10) Patent No.: US 7,572,175 B2
(45) Date of Patent: Aug. 11, 2009

(54) COOLANT SUPPLY APPARATUS FOR GRINDING MACHINE

(75) Inventor: Masahiro Ido, Kariya (JP)

(73) Assignee: JTEKT Corporation, Osaka-shi (JP)

( * ) Notice: Subject to any disclaimer, the term of this patent is extended or adjusted under 35 U.S.C. 154(b) by 0 days.

(21) Appl. No.: 11/846,815

(22) Filed: Aug. 29, 2007

(65) Prior Publication Data

US 2008/0076339 A1 Mar. 27, 2008

(30) Foreign Application Priority Data

Sep. 27, 2006 (JP) ..... 2006-262111

(51) Int. Cl.
*B24B 57/00* (2006.01)

(52) U.S. Cl. ..... 451/446; 451/449; 451/5

(58) Field of Classification Search ..... 451/5, 451/7, 8, 26, 36, 41, 60, 446, 449, 459, 488
See application file for complete search history.

(56) References Cited

U.S. PATENT DOCUMENTS 3,696,564 A * 10/1972 Joyce ..... 451/488
3,748,788 A * 7/1973 Koppenwallner ..... 451/21
3,952,458 A * 4/1976 Tomita et al. ..... 451/11
4,561,218 A * 12/1985 Dzewaltowski et al. ..... 451/27
5,833,523 A * 11/1998 Hykes ..... 451/450
6,328,636 B1 * 12/2001 Yoshimi et al. ..... 451/56

FOREIGN PATENT DOCUMENTS

| | | |
|---|---|---|
| EP | 0 924 028 A2 | 6/1999 |
| JP | 2003-103459 | 4/2003 |
| WO | WO 2004/087376 A1 | 10/2004 |

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

In a coolant supply apparatus for a grinding machine, a wheel imbalance prevention device is operated within the period from the switching to the closed state of a shut-off valve which is provided on a conduit connecting a coolant supply to a coolant nozzle, until the stop of rotation of the grinding wheel and prevents the coolant remaining in a part of the conduit on the downstream side of the shut-off valve and in the coolant nozzle from dropping on the grinding surface of the grinding wheel during the stop in rotation of the grinding wheel. Thus, the occurrence of coolant which otherwise penetrates the grinding wheel to put the same out of balance is prevented.

7 Claims, 4 Drawing Sheets

COOLANT SUPPLY APPARATUS FOR GRINDING MACHINE

INCORPORATION BY REFERENCE

This application is based on and claims priority under 35 U.S.C. 119 with respect to Japanese Application No. 2006-262111 filed on Sep. 27, 2006, the entire content of which is incorporated herein by reference.

BACKGROUND OF THE INVENTION

1. Field of the Invention

The present invention relates to a coolant supply apparatus for a grinding machine for supplying coolant toward a grinding surface of a grinding wheel.

2. Discussion of the Related Art

There has been well known an automatic balancing device for automatically correcting the rotational imbalance of a grinding wheel which is attached to a wheel spindle rotatably carried on a wheel head to be rotated at a high speed. For example, in an automatic balancing device disclosed in a Japanese unexamined published patent application No. 2003-103459, two annular rotors each having an offset load portion at a part thereof are built in a rotary section secured to a wheel spindle, while two stators facing respectively with the two rotors are provided at a stationary section secured to a wheel head. As the two stators are electrified in dependence on the magnitude of an imbalance of the grinding wheel measured by a vibration gauge during a high speed rotation of the grinding wheel, the two rotors are rotated respective correction amounts, whereby the automatic imbalance correction for the grinding wheel can be performed. In this way, the imbalance of the grinding wheel is automatically eliminated, so that the imbalance of the grinding wheel can be prevented from causing chatter marks to be created on a finish surface of a workpiece which is ground with the grinding wheel.

However, it may be sometime the case that chatter marks are made on a finish surface of a workpiece even if the same is ground with a grinding wheel the imbalance of which has been corrected by the automatic balancing device. Heretofore, in order not to create the chatter marks, the imbalance of the grinding wheel has been eliminated by the balancing device each time it is detected by a vibration gauge that the imbalance of the grinding wheel exceeds a tolerance therefor. Thus, in the case that the amount of the imbalance varies, the correction for the imbalance of the grinding wheel becomes so frequent, thereby making productivity of the grinding worse.

Inventive Activity by the Inventor

Therefore, the present inventor pursued the cause of increase in the number of imbalance correction times for the grinding wheel, and as a result, it was found that the variation in the amount of imbalance the grinding wheel occurred during a grinding or between a grinding and the next and caused chatter marks to be made on a finished surface. Further, as a result of pursuing the cause to change the imbalance amount of the grinding wheel during a grinding or between a grinding and the next, it was also found by the inventor that with the grinding wheel being held stopped, a small volume of coolant remaining in a coolant nozzle dropped onto a grinding surface of the grinding wheel and penetrated locally into a part of the grinding wheel to cause the grinding wheel to become imbalanced. That is, it was attempted to stop the grinding wheel with the balance being corrected after being rotated with a coolant being supplied toward the grinding surface thereof, to discontinue the supply of coolant from the coolant nozzle by switching a shut-off valve to a closed state, and after expiration of a predetermined time from the rotation stop, to rotate the grinding wheel again without supplying the coolant to the grinding surface. In the trial, each amount of imbalance the grinding wheel before the stop in rotation of the grinding wheel and after the resumption of the grinding wheel rotation was measured by a vibration gauge as the vibration amplitude of the wheel head, and as a result, it was found by the inventor that the amount of imbalance of the grinding wheel varied over time, as noted from the comparison of mark area 2 with mark area 1 in FIG. 5.

More specifically, it was found by the inventor that, before the stop in rotation of the grinding wheel, there was no source of imbalance on the grinding wheel because the same was being rotated with the balance corrected, and hence, the amount of the imbalance was small and hardly varied as indicated in area 1 marked in FIG. 5. However, right after resumption of rotation of the grinding wheel, the amount of imbalance increased abruptly and thereafter, decreased gradually, as indicated in area 2 marked in FIG. 5. The reason for the abrupt increase in the imbalance amount right after the rotation resumption of the grinding wheel seemed to be due to the fact that the coolant remaining in the coolant nozzle dropped on the grinding surface of the grinding wheel being held in a stopped position at that time and penetrated locally into a part of the grinding wheel so as to cause the grinding wheel to be out of balance. The reason for the gradual decrease in the imbalance thereafter seemed to be due to the fact that as the grinding wheel was rotated without supplying coolant, the occurrence of coolant locally penetrated into the grinding wheel was eliminated by the inertia force, so that the imbalance caused by the local penetration of coolant was eliminated. These facts as aforementioned were made to be clear through the inventor's research.

SUMMARY OF THE INVENTION

It is therefore a primary object of the present invention to provide an improved coolant supply apparatus capable of preventing residual coolant from dropping on a grinding surface of a grinding wheel during a stop in rotation of the grinding wheel and thus, of avoiding the occurrence of an imbalance on a grinding wheel so that chatter marks can be prevented from being made on a finish surface of a workpiece.

Briefly, according to the present invention, there is provided a coolant supply apparatus for a grinding machine having a grinding wheel attached to a wheel spindle rotatably supported by a wheel head, a coolant supply nozzle connected to a coolant supply through a conduit for supplying coolant toward a grinding surface of the grinding wheel, and a shut-off valve provided on the conduit for allowing the flow of coolant toward the coolant nozzle when in an open state and for blocking the flow of coolant when in a closed state. The apparatus further comprises a wheel imbalance prevention device operable within the period from the switching of the shut-off valve to the closed state to the stop rotation of the grinding wheel, for preventing the coolant remaining in the coolant nozzle from dropping on the grinding surface of the grinding wheel so that the grinding wheel is not put out of balance due to the coolant which would otherwise drop on the grinding surface.

With this construction, the wheel imbalance prevention device is operated within the period from switching to the closed state of the shut-off valve, which is provided on the conduit connecting the coolant supply to the coolant nozzle, to the stop in rotation of the grinding wheel and prevents the coolant remaining in the coolant nozzle from dropping on the grinding surface of the grinding wheel so that the grinding wheel is not put out of balance due to the coolant which would otherwise locally penetrate into the grinding wheel. Thus, imbalance of the grinding wheel can be prevented which would otherwise occur during the stop in rotation of the grinding wheel which causes chatter marks to be created on a finish surface of a workpiece in a grinding operation which is restarted after such stop in rotation of the grinding wheel.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENTS

Figure 1:
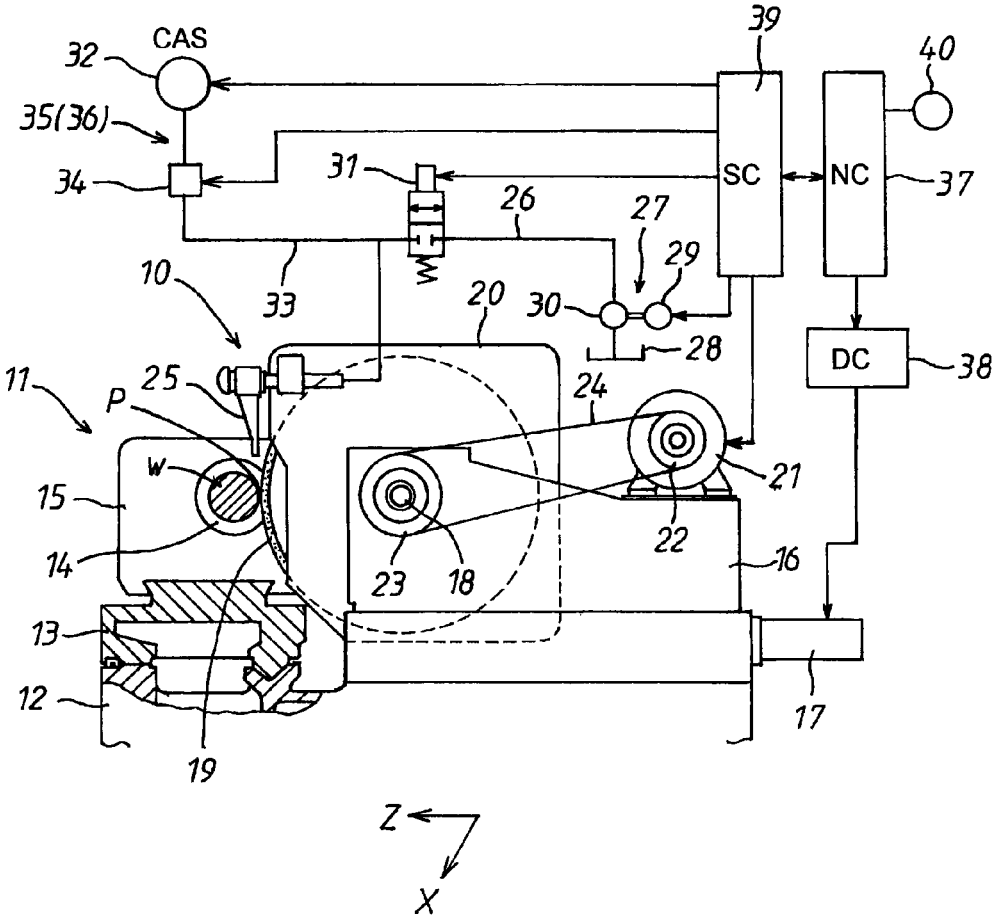
FIG. 1 is a side elevational view partly in section of a grinding machine provided with a coolant supply apparatus in a first embodiment according to the present invention.

Hereafter, embodiments according to the present invention will be described with reference to the accompanying drawings. FIG. 1 shows a grinding machine 11 provided with a coolant supply apparatus 10 in a first embodiment. On a bed 12, a work table 13 is horizontally slidably mounted and is moved by a servomotor through a ball screw feed mechanism (both not shown) in an X-axis direction. A spindle head 15 with a work spindle 14 rotatably carried therein and a foot stock (not shown) are provided on the work table 13, and a workpiece W is supported by being pressured between a center fixedly inserted into the work spindle 14 and another center provided on the foot stock, to be drivingly rotated by the work spindle 14.

A wheel head 16 is horizontally slidably mounted on the bed 12 and is moved back and forth by another servomotor 17 through a ball screw feed mechanism (not shown) in a Z-axis direction perpendicular to the X-axis. The wheel head 16 supports a wheel spindle 18 to be rotatable about an axis parallel to the X-axis, and a grinding wheel 19 is secured to one end of the wheel spindle 18. The grinding wheel 19 is surrounded at an outer circumference thereof by a cover 20 attached to the wheel head 16 and is exposed at its front part facing with the workpiece W to the outside through an opening portion formed on the cover 20. A motor 21 is fixedly mounted on a rear top surface of the wheel head 16, and the wheel spindle 18 is drivingly rotated by the motor 21 through a belt 24 wound between a pulley 22 fixedly attached to an output spindle of the motor 21 and another pulley 23 fixedly attached to the other end of the wheel spindle 18.

Next, a description will be made regarding the coolant supply apparatus 10 for the grinding machine 11 in the first embodiment. A coolant nozzle 25 for supplying coolant toward a grinding surface of the grinding wheel 19, that is, toward a grinding point (P) where the grinding wheel 19 grinds the workpiece W is attached to a portion over the work table 13 of the cover 20. The coolant nozzle 25 is fluidly connected to a coolant supply 27 through a conduit 26. The coolant supply 27 is composed of a reservoir 28 containing coolant and a pump 30 which is drivingly rotated by a motor 29 for supplying coolant from the reservoir 28 through the conduit 26 to the coolant nozzle 25. The conduit 26 is provided thereon with an electromagnetic shut-off valve 31 at a position adjacent to the coolant nozzle 25, that is, at a position which is adjacent to the coolant nozzle 25 and on the upstream side of the same. The electromagnetic shut-off valve 31 allows the coolant to flow from the coolant supply 27 toward the coolant nozzle 25 when in an open state, but blocks the flow of coolant when in a closed state.

Numeral 32 denotes a compressed air source labeled CAS for supplying compressed air which is compressed by a compressor (not shown). The compressed air source 32 is fluidly connected through an air conduit 33 to the conduit 26 on a close downstream side of the electromagnetic shut-off valve 31, that is, at a position which is adjacent to the electromagnetic shut-off valve 31 and on the downstream side of the same. An electromagnetic air shut-off valve 34 is provided on the air conduit 33 at a position adjacent to a connection point of the air conduit 33 with the conduit 26. The compressed air source 32, the air conduit 33, the electromagnetic air shut-off valve 34, and the like constitute a coolant discharge device 35, which brings the electromagnetic air shut-off valve 34 into an open state within a period from the switching of the electromagnetic shut-off valve 31 to the closed state to the rotation stop of the grinding wheel 19. When brought into the open state, the electromagnetic air shut-off valve 34 supplies the conduit 26 with the compressed air at a position adjacent to, and on the downstream side of, the electromagnetic shut-off valve 31 to discharge the coolant which remains in a part of the conduit 26 on the downstream side of the electromagnetic shut-off valve 31 and in the coolant nozzle 25.

When the electromagnetic shut-off valve 31 is switched to the closed state, coolant remains in the part of the conduit 26 on the downstream side of the electromagnetic shut-off valve 31 and in the coolant nozzle 25. The coolant remaining in the coolant nozzle 25 and the like may drop on the grinding surface of the grinding wheel 19 during the stop in rotation of the grinding wheel 19, and the drops of coolant may penetrate locally into the grinding wheel 19 to put the grinding wheel 19 out of balance by an extremely small magnitude. In order to prevent this, when the electromagnetic shut-off valve 31 is switched to the closed state, the coolant discharge device 35 discharges the coolant which remains in the part of the conduit 26 on the downstream side of the electromagnetic shut-off valve 31 and in the coolant nozzle 25, to prevent the grinding wheel 19 from being put out of balance due to the residual coolant dropping on the grinding surface. Therefore, the coolant discharge device 35 is brought into operation for a predetermined time, e.g., ten seconds or so within the period from the switching of the electromagnetic shut-off valve 31 to the closed state to the stop in rotation of the grinding wheel 19, and with the electromagnetic shut-off valve 31 being in the closed state, prevents the coolant which remains in the part of the conduit 26 on the downstream side of the electromagnetic shut-off valve 31 and in the coolant nozzle 25, from dropping on the grinding surface of the grinding wheel 19. That is, the coolant discharge device 35 functions as a wheel imbalance prevention device 36 which prevents the grinding wheel 19 from being put out of balance due to the coolant dropping on the grinding surface.

A numerical controller 37 labeled NC for executing a grinding cycle is connected to the servomotor 17 and the like through a drive circuit 38 labeled DC. The grinding cycle is to be executed after the work table 13 is moved and positioned by the servomotor (not shown) to bring a ground portion on a workpiece W before the grinding wheel 19, for moving the wheel head 16 toward and away from the workpiece W through rotation control of the servomotor 17 in order to grind the ground portion of the workpiece W with the grinding wheel 19. A sequence controller 39 labeled SC is connected to the numerical controller 37 and controls the rotation/stop of the motor 21, the openings/closings of the electromagnetic shut-off valve 31 and the electromagnetic air shut-off valve 34, and the like in response to commands from the numerical controller 37.

Next, the operation of the coolant supply apparatus 10 for the grinding machine 11 in the first embodiment will be described by reference to a flow chart executed by the numerical controller 37. Referring to the flow chart shown in FIG. 2, when operation of the grinding machine 11 is started (step S41), the wheel spindle 18 with the grinding wheel 19 mounted thereon is rotated by the motor 21 at a high speed, the pump 30 is driven by the motor 29 to supply coolant to the electromagnetic shut-off valve 31, and the compressor (not shown) is started so as to supply compressed air from the compressed air supply 32 to the electromagnetic air shut-off valve 34. When a grinding cycle start button (not shown) is pushed with the workpiece W supported between the centers of the work head 15 and the foot stock (not shown), the work spindle 14 and hence, the workpiece W are drivingly rotated, the work table 13 is positioned in the X-axis direction to bring a ground portion of the workpiece W before the grinding wheel 19, and the electromagnetic shut-off valve 31 is switched to the open state, whereby coolant is supplied toward the grinding point (P) on the grinding surface of the grinding wheel 19 (step S42). The wheel head 16 is advanced against the workpiece W in turn at a rapid feed rate, a rough grinding feed rate and a fine grinding feed rate and then, is stopped for a short period of time, whereby the ground portion of the workpiece W is ground to a predetermined dimension in turn through a rough grinding, a fine grinding and a spark-out grinding. Subsequently, the wheel head 16 is retracted to a retracted position at a rapid feed rate, and after the rotation stop of the work spindle 14, the ground workpiece W is unloaded from between the centers of the work head 15 and the foot stock (step S43). Thereafter, it is determined whether or not a stop command has been issued by the depression of a grinding machine stop button 40 (step S44). If the stop command has not been issued, an unfinished workpiece W is mounted between the centers of the work head 15 and the foot stock, and the foregoing grinding cycle is repeated.

Upon issuance of the grinding machine stop command, on the other hand, the driving of the pump 30 by the motor 29 is stopped, in which state, the electromagnetic shut-off valve 31 is switched to the closed state (step S45). Then, the electromagnetic air shut-off valve 34 is switched to the open state. Thus, compressed air is supplied for a period of, e.g., ten seconds to the part of the conduit 26 which part is adjacent to, and on the downstream of, the electromagnetic shut-off valve 31, whereby the coolant remaining in the part of the conduit 26 on the downstream side of the electromagnetic shut-off valve 31 as well as in the coolant nozzle 25 is discharged out from the coolant nozzle 25 (step S46). A command for the wheel spindle 18 stop is then issued, whereby the motor 21 is stopped so as to stop the rotation of the grinding wheel 19 (step S47). The coolant which has adhered to the surface of the grinding wheel 19 is splashed and eliminated by the inertia by the time the grinding wheel 19 stops completely. As a consequence, because upon complete rotation stop of the grinding wheel 19, the coolant no longer remains in the part of the conduit 26 on the downstream side of the electromagnetic shut-off valve 31 as well as in the coolant nozzle 25, no residual coolant drops on the grinding surface of the grinding wheel 19 occur during the rotation stop of the same, and hence, the grinding wheel 19 is not put out of balance due to the coolant which drops on the grinding surface.

In accordance with the aforementioned flow chart, the rotation stop command for the wheel spindle 18 is issued after the switching of the electromagnetic shut-off valve 31 to the closed state and after the switching of the electromagnetic air shut-off valve 34 to the open state. However, in a modified form, the rotation stop command for the wheel spindle 18 may be issued in response to the grinding machine stop command which is issued upon depression of the grinding machine stop button 40, the grinding completion of a predetermined number of workpieces W, the termination of the working hours or the like. In this modified case, since the grinding wheel 19 continues to rotate by the inertia for a while after the discontinuation of electric power to the motor 21, the electromagnetic shut-off valve 31 and the electromagnetic air shut-off valve 34 may be switched respectively to the closed state and the open state before the inertia rotation of the grinding wheel 19 discontinues, preferably before the rotation of the grinding wheel 19 lowers to a predetermined rotational speed. This can also prevent the coolant remaining in the part of the conduit 26 on the downstream side of the electromagnetic shut-off valve 31 as well as in the coolant nozzle 25, from dropping upon the grinding surface of the grinding wheel 19 being held stopped, and therefore, the grinding wheel 19 is not put out of balance due to the coolant which otherwise drops on the grinding surface.

Figure 5:
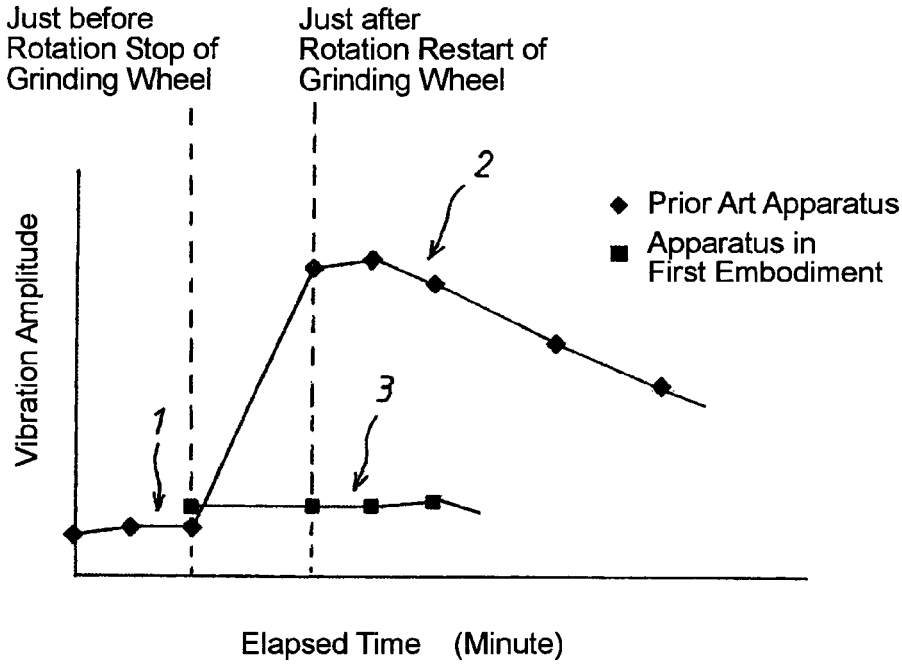
FIG. 5 is a graph showing a time-dependent change of a grinding wheel amount of imbalance before the rotation stop of a grinding wheel and after restart in the rotation of the grinding wheel.

To evaluate the effect of the coolant supply apparatus 10 in the first embodiment, a test operation was performed, in which the amount of imbalance of the grinding wheel 19 was measured as the vibration amplitude of a vibration gauge placed on the wheel head 16 before the rotation stop of the grinding wheel 19 and after rotation restart of the grinding wheel 19. In this test operation, the grinding wheel 19 with the balance corrected was first rotated with coolant being supplied toward the grinding surface thereof, then the same operations as described at steps S45-S47 were performed to discharge from the coolant nozzle 25 the coolant remaining in the part of the conduit 26 on the downstream side of the electromagnetic shut-off valve 31 as well as in the coolant nozzle 25, and thereafter, rotation of the grinding wheel 19 was stopped. Further, after expiration of a suitable time period, the rotation of the grinding wheel 19 was restarted without supplying any coolant. FIG. 5 shows the test result. In the apparatus 10 in the first embodiment, the amount of imbalance of the grinding wheel 19 just after rotation restart of the grinding wheel 19 was only a slight increase as compared with a small amount of imbalance before the stop of rotation and did not change thereafter, as was clear from the comparison of values at area 3 as marked with those at area 1 as so marked. With respect to the vibration magnitude of the wheel head 16 just after rotation restart of the grinding wheel 19, the coolant supply apparatus 10 in the first embodiment wherein the residual coolant was prevented from dropping on the grinding surface of the grinding wheel 19 during the rotation stop of the same was reduced to one fifth ($1/5^{th}$) of the prior art apparatus wherein such coolant dropping was not prevented, as demonstrated from the comparison of values at area 3 as marked with those at area 2 as so marked.

Second Embodiment

Next, with reference to FIG. 3, a coolant supply apparatus 50 for a grinding machine in a second embodiment will be described with the focus on those respects different from the coolant supply apparatus 10 for the grinding machine 11 in the foregoing first embodiment. A base portion of the coolant nozzle 25 is carried by a support member 51 which is secured to the cover 20 so as to be pivotable about an axis parallel to the Z-axis, and is configured to be pivotable by a cylinder device 52 through a rack-and-pinion mechanism (not shown). The conduit 26 is jointed to the support member 51 and communicates with the coolant nozzle 25 through a fitting hole formed in the support member 51. The support member 51 secured to the cover 20, the cylinder device 52, the rack-and-pinion mechanism and the like constitute a nozzle direction alteration device 53 which is capable of altering the orientation or direction of the coolant nozzle 25 between a first direction in which coolant is supplied toward the grinding point (P) on the grinding surface of the grinding wheel 19 and a second direction in which the coolant remaining in the coolant nozzle 25 does not drop on the grinding surface. In the second direction indicated by the two-dot-chain line in FIG. 3, the coolant nozzle 25 has been pivoted through half revolution with an ejection port of the nozzle 25 oriented upward. However, the second direction is not limited to this and may be such that the coolant nozzle 25 has been pivoted to any other angular position (e.g., a horizontal position) where it does not drop coolant from the ejection port thereof on the grinding surface.

In the second embodiment, driving of the pump 30 by the motor 29 is stopped upon issuance of the grinding machine stop command, and within the period from the switching of the electromagnetic shut-off valve 31 to the closed state to the rotation stop of the grinding wheel 19, the coolant nozzle 25 is pivoted by the cylinder device 52 through the rack-and-pinion mechanism, whereby the coolant nozzle 25 is altered to take the second direction in which it does not drop coolant on the grinding surface of the grinding wheel 19. Accordingly, the nozzle direction alteration device 53 is brought into operation within the period from the switching of the electromagnetic shut-off valve 31 to the closed state to the rotation stop of the grinding wheel 19 and prevents the coolant remaining in the part of the conduit 26 on the downstream side of the electromagnetic shut-off valve 31 as well as in the coolant nozzle 25 with the electromagnetic shut-off valve 31 being held in the closed state, from dropping onto the grinding surface of the grinding wheel 19 upon the same being held stopped. Thus, the nozzle direction alteration device 53 serves as a wheel imbalance prevention device 36 which prevents the grinding wheel 19 from being put out of balance due to the coolant dropping on the grinding surface.

Third Embodiment

Next, with reference to FIG. 4, a coolant supply apparatus 60 for a grinding machine in a third embodiment will be described with the focus on those respects different from the coolant supply apparatus 10 for the grinding machine 11 in the foregoing first embodiment. An arm portion 64 of a closing member 63 which is provided with a bowl portion 62 at an extreme end thereof is supported by a bracket 61 attaching the coolant nozzle 25 to the cover 20, to be pivotable about an axis parallel to the Z-axis. The closing member 63 is pivoted by a cylinder device 65 through a rack-and-pinion mechanism incorporated in the bracket 61 and thus, is pivotally movable between a first position where the bowl portion 62 is put under the ejection port of the coolant nozzle 25 to prevent the coolant from dropping on the grinding surface and a second position where the bowl portion 62 moves away from under the ejection port to allow the coolant to be supplied from the ejection port of the coolant nozzle 25 toward the grinding surface of the grinding wheel 19. At the second position indicated by the two-dot-chain line in FIG. 4, the closing member 63 has been pivoted through a half revolution from the first position to direct the bowl portion 62 upside down. However, the second position is not limited to this angular position and may be any other angular position where the closing member 63 is turned and offsets or deviates the bowl portion 62 from under the ejection port not to intercept the coolant flow ejected from the coolant nozzle 25. The closing member 63, the cylinder device 65, the rack-and-pinion mechanism and the like constitute a nozzle ejection port closing device 66 which is brought by the cylinder device 65 and the rack-and-pinion mechanism under the ejection port of the coolant nozzle 25 to prevent the coolant from dropping on the grinding surface of the grinding wheel 19.

In the third embodiment, the driving of the pump 30 by the motor 29 is stopped upon issuance of the grinding machine stop command, and within the period from the switching of the electromagnetic shut-off valve 31 to the closed state to the rotation stop of the grinding wheel 19, the closing member 63 is pivoted by the cylinder device 65 through the rack-and-pinion mechanism, whereby the bowl portion 62 is placed under the ejection port of the coolant nozzle 25 to catch the drops of residual coolant from the coolant nozzle 25 and hence, to prevent the residual coolant from dropping on the grinding surface of the grinding wheel 19. Accordingly, the nozzle ejection port closing device 66 is brought into operation within the period from the switching of the electromagnetic shut-off valve 31 to the closed state to the rotation stop of the grinding wheel 19 and prevents the coolant which remains in the part of the conduit 26 on the downstream side of the electromagnetic shut-off valve 31 as well as in the coolant nozzle 25 while the electromagnetic shut-off valve 31 is in the closed state, from dropping on the grinding surface of the grinding wheel 19 being held stopped. Thus, the nozzle ejection port closing device 66 serves as the wheel imbalance prevention device 36 which prevents the grinding wheel 19 from being put out of balance due to the coolant dropping on the grinding surface.

Although in the foregoing embodiments, opening/closing means for allowing the flow of coolant to the coolant nozzle 25 in the open state and for blocking the flow of coolant in the closed state has been described taking an example of the electromagnetic shut-off valve 31, the present invention is not limited to the employment of such a valve. In a modified form, the opening/closing means may be any other valve means which is capable of selectively allowing the flow of coolant through the conduit 26, or any other means equivalent in function to such valve means.

Figure 2:
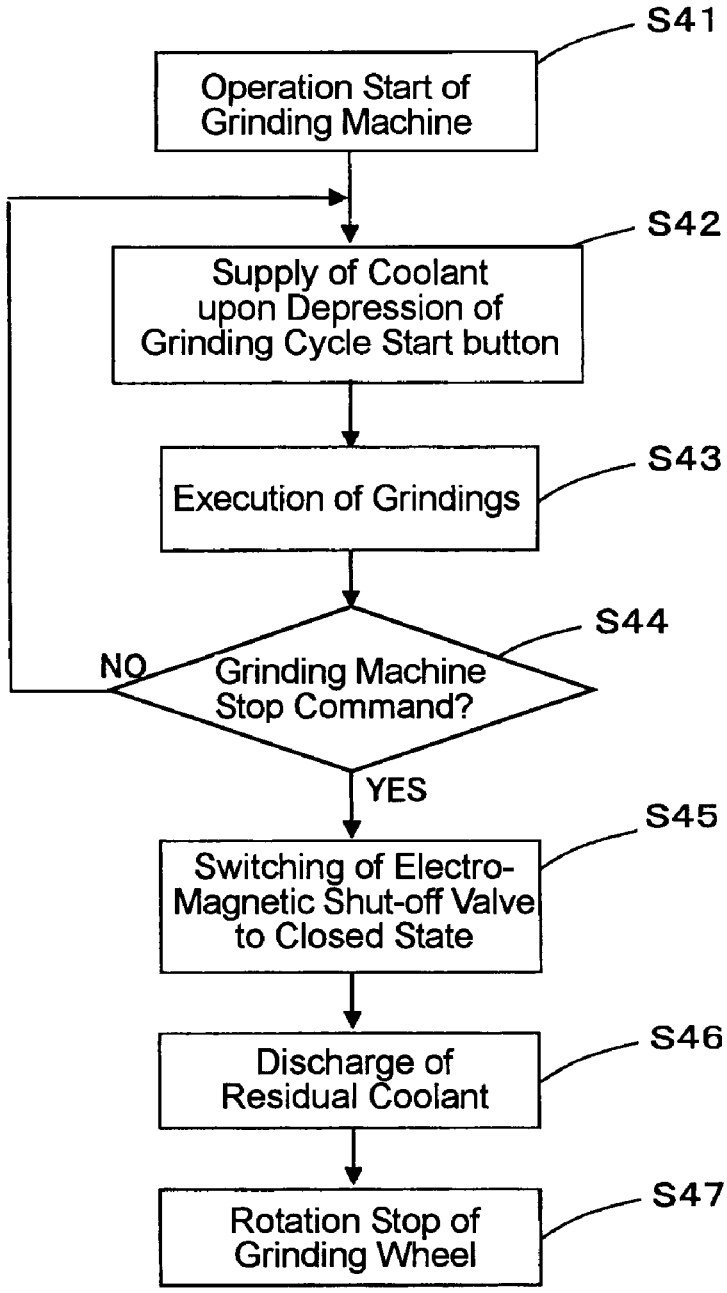
FIG. 2 is a flow chart for controlling the coolant supply apparatus of the grinding machine.

Various features and many of the attendant advantages in the foregoing embodiments will be summarized as follows:

In the coolant supply apparatus 10 in the foregoing first embodiment shown in FIGS. 1 and 2, the wheel imbalance prevention device 36 is operated within the period from the switching to the closed state of the shut-off valve 31 which is provided on the conduit 26 connecting the coolant supply 27 to the coolant nozzle 25, to the rotation stop of the grinding wheel 19 and prevents by the shut-off valve 31 the coolant remaining in the part of the conduit 26 on the downstream side of the shut-off valve 31 and in the coolant nozzle 25, from dropping on the grinding surface of the grinding wheel 19 so that the grinding wheel 19 is not put out of balance due to the coolant which would otherwise locally penetrate into the grinding wheel 19. Thus, it can be prevented that the imbalance of the grinding wheel 19 which would otherwise occur during the rotation stop of the grinding wheel 19 causes chatter marks to be created on a finish surface of a workpiece W in a grinding operation which is restarted after such rotation stop of the grinding wheel 19.

In the coolant supply apparatus 10 in the foregoing first embodiment shown in FIGS. 1 and 2, the wheel imbalance prevention device 36 brings the shut-off valve 31 into the closed state before issuance of a command for the rotation stop of the grinding wheel 19 and prevents by the shut-off valve 31 the coolant remaining in the part of the conduit 26 on the downstream side of the shut-off valve 31 and in the coolant nozzle 25, from dropping on the grinding surface of the grinding wheel 19. Thus, it can be prevented that the grinding wheel 19 is put out of balance due to the coolant which would otherwise drop on the grinding surface of the grinding wheel 19.

Also in the coolant supply apparatus 10 in the foregoing first embodiment shown in FIGS. 1 and 2, the wheel imbalance prevention device 36 brings the shut-off valve 31 into the closed state after issuance of the command for the rotation stop of the wheel spindle 18 and before the substantial stopping of the wheel spindle 18 rotation and prevents by the shut-off valve 31 the coolant remaining in the part of the conduit 26 on the downstream side of the shut-off valve 31 and in the coolant nozzle 25, from dropping on the grinding surface of the grinding wheel 19. Thus, the grinding wheel 19 can be prevented from being put out of balance due to the coolant which would otherwise drop on the grinding surface of the grinding wheel 19.

Also in the coolant supply apparatus 10 in the foregoing first embodiment shown in FIGS. 1 and 2, compressed air is supplied to a part in the conduit 26 which part is adjacent to the shut-off valve 31 and on the downstream side of the same within the period from the switching to the closed state of the shut-off valve 31 which is provided on the conduit 26 connecting the coolant supply 27 to the coolant nozzle 25, to the rotation stop of the grinding wheel 19. This results in discharging the coolant which remains in the part of the conduit 26 on the downstream side of the shut-off valve 31 and in the coolant nozzle 25. Therefore, it can be prevented that the residual coolant drops on the grinding surface of the grinding wheel 19 during the rotation stop of the grinding wheel 19.

Figure 3:
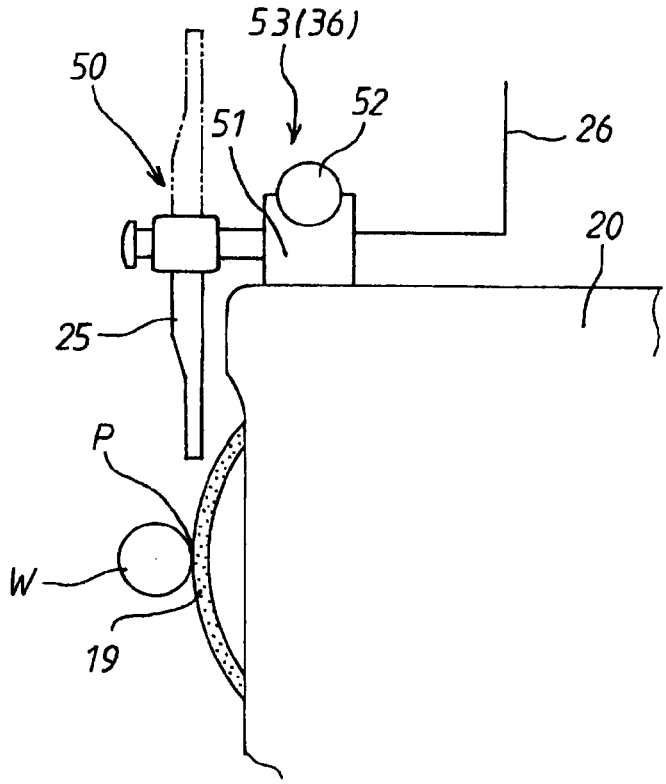
FIG. 3 is a fragmentary view of a coolant supply apparatus for a grinding machine in a second embodiment according to the present invention.

In the coolant supply apparatus 50 in the foregoing second embodiment shown in FIG. 3, the direction of the coolant nozzle 25 is altered with respect to a direction in which coolant from the coolant nozzle 25 does not drop on the grinding surface, and the alteration is performed within the period from the switching to the closed state of the shut-off valve 31 which is provided on the conduit 26 connecting the coolant supply 27 to the coolant nozzle 25, to point in time of rotation stopping of the grinding wheel 19. Therefore, residual coolant drops can be prevented from occurring on the grinding surface of the grinding wheel 19 during the stop in rotation of the grinding wheel 19.

Figure 4:
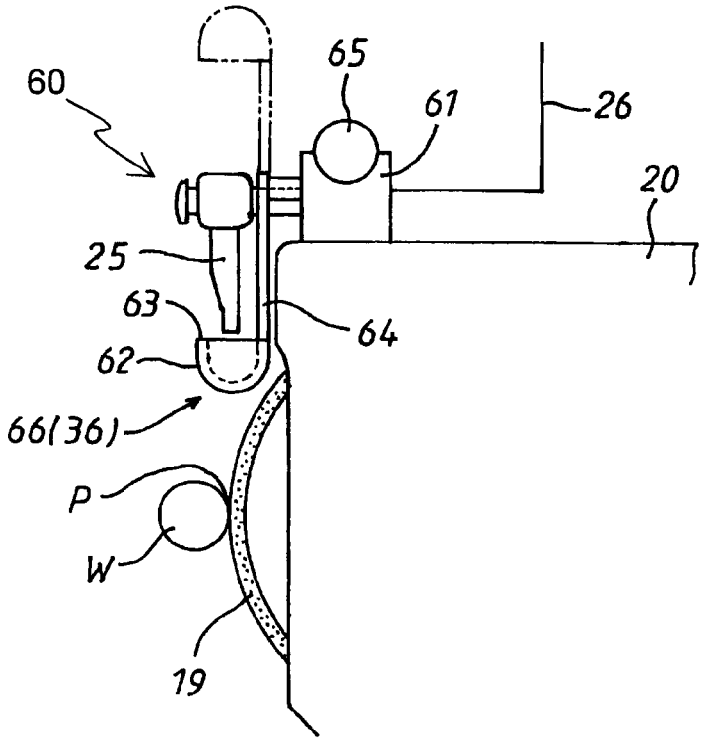
FIG. 4 is a fragmentary view of a coolant supply apparatus for a grinding machine in a third embodiment according to the present invention.

In the coolant supply apparatus 60 in the foregoing third embodiment shown in FIG. 4, the ejection port of the coolant nozzle 25 is closed to prevent coolant drops therefrom from occurring on the grinding surface of the grinding wheel 19, and closing of the ejection port is performed within the period from the switching to the closed state of the shut-off valve 31 which is provided on the conduit 26 connecting the coolant supply 27 to the coolant nozzle 25, to the point in time of rotation stop of the grinding wheel 19. Therefore, residual coolant drops on the grinding surface of the grinding wheel 19 can be prevented during the stopping rotation of the grinding wheel 19.

The wheel unbalance prevention device 36 in each of the foregoing first to third embodiments has been described as being operable to prevent the coolant remaining in the part of the conduit 26 on the downstream side of the shut-off valve 31 as well as in the coolant nozzle 25, from dropping on the grinding surface of the grinding wheel 19. However, it suffices for the function of the wheel unbalance prevention device 36 in each embodiment to prevent the coolant remaining in the coolant nozzle 25 from dropping on the grinding surface, because the coolant remaining between the shut-off valve 31 and the coolant nozzle 25 does not drop on the grinding surface unless the coolant in the coolant nozzle 25 first drops.

Obviously, numerous further modifications and variations of the present invention are possible in light of the above teachings. It is therefore to be understood that within the scope of the appended claims, the present invention may be practiced otherwise than as specifically described herein.

What is claimed is:

1. A coolant supply apparatus for a grinding machine having a grinding wheel attached to a wheel spindle rotatably supported by a wheel head, a coolant supply nozzle connected to a coolant supply through a conduit for supplying coolant toward a grinding surface of the grinding wheel, and a shut-off valve provided on the conduit for allowing the flow of coolant toward the coolant nozzle when in an open state and for blocking the flow of coolant when in a closed state, the apparatus further comprising:

wheel imbalance prevention means operable within the period from the switching of the shut-off valve to the closed state to a stop in rotation of the grinding wheel, for preventing the coolant remaining in the coolant nozzle from dropping on the grinding surface of the grinding wheel so that the grinding wheel is not put out of balance due to the coolant which would otherwise drop on the grinding surface.

2. The coolant supply apparatus as set forth in claim 1, wherein the wheel imbalance prevention means brings the shut-off valve into the closed state before a stop command for the wheel spindle is issued so that the coolant remaining in the coolant nozzle is prevented from dropping on the grinding surface of the grinding wheel.

3. The coolant supply apparatus as set forth in claim 1, wherein the wheel imbalance prevention means brings the shut-off valve into the closed state after a stop command for the wheel spindle is issued and before the rotation of the wheel spindle is stopped so that the coolant remaining in the coolant nozzle is prevented from dropping on the grinding surface of the grinding wheel.

4. The coolant supply apparatus as set forth in claim 1, wherein the wheel imbalance prevention means comprises a coolant discharge device which supplies compressed air into a part of the conduit on the downstream of the shut-off valve within the period from the switching of the shut-off valve to the closed state to the rotation stop of the grinding wheel, for discharging the coolant remaining in the part of the conduit on the downstream side of the shut-off valve and in the coolant nozzle.

5. The coolant supply apparatus as set forth in claim 1, wherein the wheel imbalance prevention means comprises a nozzle direction alteration device which alters the direction of the coolant nozzle to a direction in which the residual coolant in the coolant nozzle does not drop on the grinding surface.

6. The coolant supply apparatus as set forth in claim 1, wherein the wheel imbalance prevention means comprises a nozzle ejection port closing device which is brought into a position to close an ejection port of the coolant nozzle within the period from the switching of the shut-off valve to the closed state to the rotation stop of the grinding wheel, for preventing the coolant from the ejection port from dropping on the grinding surface during a stop in rotation of the grinding wheel.

7. The coolant supply apparatus as set forth in claim 6, wherein the nozzle ejection port closing device includes a bowl portion which catches the drops of coolant from the ejection port of the coolant nozzle for preventing the drops from falling on the grinding surface during a stop in rotation of the grinding wheel.

* * * * *